US010767145B2

(12) United States Patent
Piorkowski

(10) Patent No.: US 10,767,145 B2
(45) **Date of Patent: *Sep. 8, 2020**

(54) SINGLE DOSE SACCHARIDE-BASED SCENT BOOSTING PACKS

(71) Applicant: Henkel IP & Holding GmbH, Duesseldorf (DE)

(72) Inventor: Daniel T Piorkowski, Fairfield, CT (US)

(73) Assignee: Henkel IP & Holding GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/168,079

(22) Filed: Oct. 23, 2018

(65) Prior Publication Data

US 2020/0123479 A1 Apr. 23, 2020

(51) Int. Cl.

| | |
|---|---|
| ***C11D 1/72*** | (2006.01) |
| ***C11D 3/22*** | (2006.01) |
| ***C11D 3/43*** | (2006.01) |
| ***C11D 3/50*** | (2006.01) |
| ***C11D 17/04*** | (2006.01) |

(52) U.S. Cl.

CPC ..... *C11D 17/043* (2013.01); *C11D 1/72* (2013.01); *C11D 3/221* (2013.01); *C11D 3/43* (2013.01); *C11D 3/505* (2013.01)

(58) Field of Classification Search

CPC .... C11D 1/72; C11D 3/22; C11D 3/43; C11D 3/50; C11D 17/043

See application file for complete search history.

(56) References Cited

U.S. PATENT DOCUMENTS

| | | | | |
|---|---|---|---|---|
| 10,519,407 | B2 * | 12/2019 | Piorkowski | C11D 3/42 |
| 2017/0137750 | A1 | 5/2017 | Zhang | |
| 2017/0226690 | A1 | 8/2017 | Brain et al. | |
| 2018/0216033 | A1 * | 8/2018 | Camire | C11D 3/2086 |
| 2018/0216034 | A1 | 8/2018 | Camire | |

FOREIGN PATENT DOCUMENTS

| | | |
|---|---|---|
| EP | 2982738 B1 | 2/2016 |

OTHER PUBLICATIONS

European Search Report EP 19187836.2 dated Jan. 30, 2020 8 pages.

* cited by examiner

*Primary Examiner* — Brian P Mruk
(74) *Attorney, Agent, or Firm* — Bojuan Deng

(57) ABSTRACT

A single dose pack includes a container including a water-soluble film and a single dose scent boosting composition encapsulated within the container. The single dose scent boosting composition includes about 0.1 to about 10 weight percent of a fragrance based on a total weight of the scent-boosting composition, about 45 to about 75 weight percent of a saccharide based on a total weight of the scent-boosting composition, about 0.1 to about 6 weight percent of a surfactant based on a total weight of the scent-boosting composition; and about 10 to about 25 weight percent of water based on a total weight of the scent-boosting composition.

20 Claims, 1 Drawing Sheet

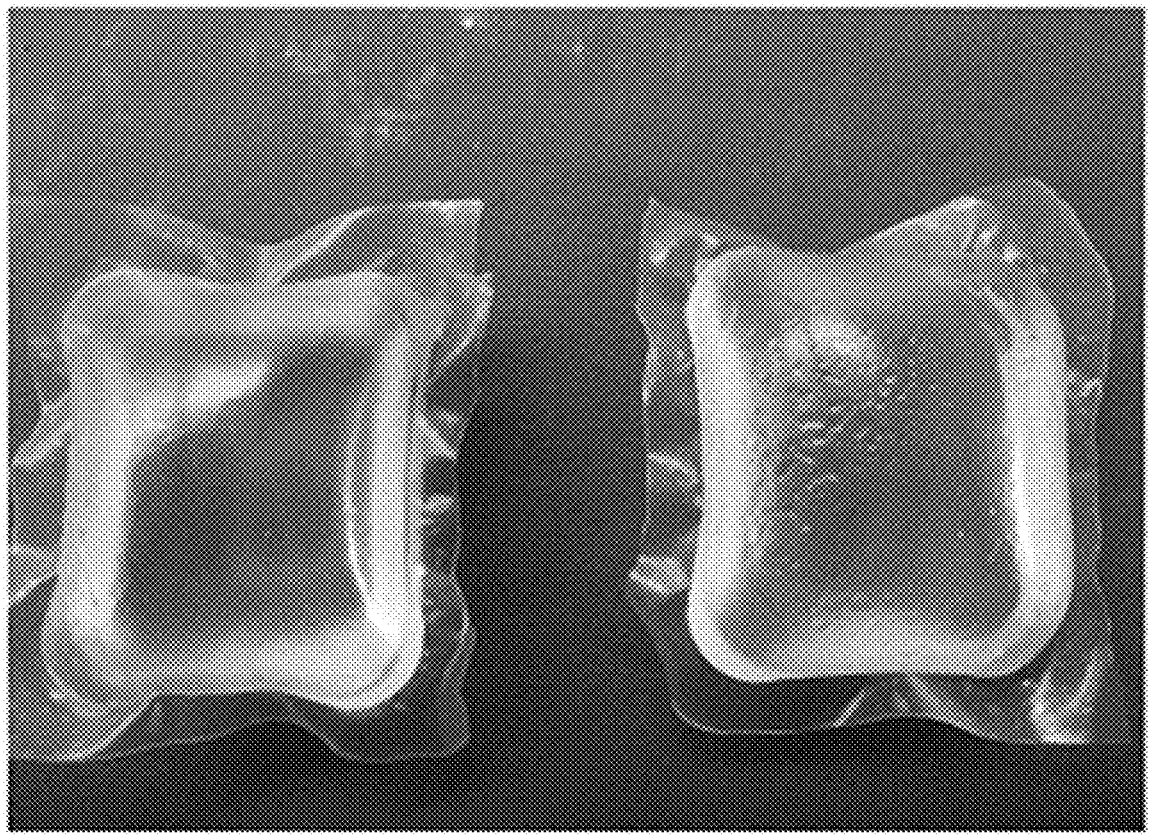

SINGLE DOSE SACCHARIDE-BASED SCENT BOOSTING PACKS

TECHNICAL FIELD

The present disclosure generally relates to a single dose pack that includes a scent boosting composition, and methods of forming both the composition and the pack. More specifically, the scent boosting composition includes a fragrance, a saccharide, a surfactant, and water.

BACKGROUND

Many consumers prefer strong and long-lasting scents on their laundry even weeks after washing. In laundry applications, it is desirable to enhance the consumer experience by releasing scent at different consumer contact points. Current commercial products do not provide long-lasting, strong to intermediate scent after washing at a reasonable price in a single dose pack.

Many current scent boosting compositions in single dose are in solid form and include sodium chloride as a filler. Scent boosting compositions in single dose liquid form are not common. Typical single dose liquid form packs are detergent based and include solvents such as glycerin, propylene glycol and polyethylene glycol as well as surfactants such as alcohol ethoxylates, SLES, fatty acids and LAS form the majority of the formulations disposed therein. However, all of these materials are expensive as compared to the cost of sodium chloride. For this reason, liquid scent boosting compositions tend to be too expensive to produce. Furthermore, when these solvents and surfactants are removed from the formulations, other compounds must be used in their place. However, many of these other compounds, such as water, tend to cause significant film instabilities such as floppiness, pack leakage, pack fusion, insolubility, etc.

Accordingly, there remains an opportunity to develop a single dose pack that performs well, is stable, resists premature degradation, and includes a scent boosting composition. Furthermore, other desirable features and characteristics of the present disclosure will become apparent from the subsequent detailed description of the disclosure and the appended claims, taken in conjunction this background of the disclosure.

SUMMARY

This disclosure provides a single dose pack that includes a container including a water-soluble film and a single dose scent boosting composition encapsulated within the container. The single dose scent boosting composition includes about 0.1 to about 10 weight percent of a fragrance based on a total weight of the scent-boosting composition, about 45 to about 75 weight percent of a saccharide based on a total weight of the scent-boosting composition, about 0.1 to about 6 weight percent of a surfactant based on a total weight of the scent-boosting composition; and about 10 to about 25 weight percent of water based on a total weight of the scent-boosting composition. In one embodiment, the single dose scent boosting composition also includes non-aqueous solvent present in an amount of from about 5 to about 30 weight percent based on a total weight of the composition.

This disclosure also provides the single dose scent boosting composition itself and a method of forming the single dose scent boosting composition. The method includes the step of combining the fragrance, the saccharide, the surfactant, and the water to form the single dose scent boosting composition.

The single dose scent boosting composition exhibits superior and unexpected results. More specifically, the use of a saccharide surprisingly allows for large amounts of water to be included in single dose packs which, in turn, allows for simplified formulations to be produced, less chemicals to be used, less chemical waste to be generated, and decreased production costs to be realized. Moreover, use of a small amount of a non-aqueous solvent, such as polyethylene glycol, in conjunction with the saccharide, even further synergistically improves the stability of the packs which allows the packs to be used in a wider variety of environments and reduces premature breakdown and release of contents.

BRIEF DESCRIPTION OF THE DRAWINGS

The present invention will hereinafter be described in conjunction with the following drawing figures, wherein like numerals denote like elements, and FIG. 1 is a photograph of two packs set forth in the Examples after having been stored at a temperature of 75° F. temperature and 50% humidity for 1 week. The pack on the left is the pack of Composition 1 and is stable. The pack on the right is the pack of Composition 2 and shows phase separation of the fragrance neat oil from the water in the pack.

DETAILED DESCRIPTION

The following detailed description is merely exemplary in nature and is not intended to limit the disclosure. Furthermore, there is no intention to be bound by any theory presented in the preceding background or the following detailed description.

Embodiments of the present disclosure are generally directed to single dose scent boosting compositions and methods for forming the same. For the sake of brevity, conventional techniques related to single dose scent boosting compositions may not be described in detail herein. Moreover, the various tasks and process steps described herein may be incorporated into a more comprehensive procedure or process having additional steps or functionality not described in detail herein. In particular, various steps in the manufacture of single dose scent boosting compositions are well-known and so, in the interest of brevity, many conventional steps will only be mentioned briefly herein or will be omitted entirely without providing the well-known process details.

Single Dose Pack:

This disclosure provides a single dose pack that includes a container including a water-soluble film and a single dose scent boosting composition encapsulated within the container, each as described below.

A single dose pack can be formed by encapsulating the single dose scent boosting composition within the container, wherein the container includes a film. In some embodiments, the film forms one half or more of the container, where the container may also include dyes or other components. In some embodiments, the film is water soluble such that the film will completely dissolve when an exterior of the film is exposed to water, such as in a washing machine typically used for laundry. When the film dissolves, the container is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The single dose pack may be formed from a container having a single section, but the single dose pack may be formed from containers with two or more different sections in alternate embodiments. In embodiments with a container having two or more sections, the contents of the different sections may or may not be the same.

Single Dose Scent Boosting Composition

This disclosure provides the single dose scent boosting composition, first introduced above and hereinafter referred to as a composition. The composition may be, include, consist essentially of, or consist of, a fragrance, a saccharide, a surfactant, and water, e.g. in any one or more of the amounts described in greater detail below.

In one embodiment, the composition comprises the fragrance, the saccharide, the surfactant, and the water.

In another embodiment, the composition consists essentially of the fragrance, the saccharide, the surfactant, and the water.

In yet another embodiment, the composition comprises the fragrance, the saccharide, the surfactant, the water, and a non-aqueous solvent.

In a further embodiment, the composition consists essentially of the fragrance, the saccharide, the surfactant, the water, and the non-aqueous solvent.

In another embodiment, the composition consists of the fragrance, the saccharide, the surfactant, and the water.

In yet another embodiment, the composition consists of the fragrance, the saccharide, the surfactant, the water, and the non-aqueous solvent.

In a further embodiment, the composition comprises about 0.1 to about 10 weight percent of a fragrance based on a total weight of the composition, about 45 to about 75 weight percent of a saccharide based on a total weight of the composition, about 0.1 to about 6 weight percent of a surfactant based on a total weight of the composition; and about 10 to about 25 weight percent of water based on a total weight of the composition.

In another embodiment, the composition consists essentially of about 0.1 to about 10 weight percent of a fragrance based on a total weight of the composition, about 45 to about 75 weight percent of a saccharide based on a total weight of the composition, about 0.1 to about 6 weight percent of a surfactant based on a total weight of the composition; and about 10 to about 25 weight percent of water based on a total weight of the composition.

In still a further embodiment, the composition consists of about 0.1 to about 10 weight percent of a fragrance based on a total weight of the composition, about 45 to about 75 weight percent of a saccharide based on a total weight of the composition, about 0.1 to about 6 weight percent of a surfactant based on a total weight of the composition; and about 10 to about 25 weight percent of water based on a total weight of the composition.

In still other embodiments, the composition may comprise, consist essentially of, or consist of, any combination of components described herein.

In further embodiments, the composition is free of, or includes less than 1, 0.5, 0.1, 0.05, or 0.01, weight percent of, any one or more of the optional components or additives described below and/or those such as, but not limited to, solid sodium chloride, solid scent boosters, encapsulated solid scent boosters, e.g. encapsulated in polyvinyl alcohol film, etc.

The composition that is encapsulated is typically described as a liquid and typically has a viscosity of from about 50 to about 2000 cps at about 70° F. measured at 20 rpm using an LV02 (62) spindle of a Brookfield Viscometer (DV2T). In various embodiments, the viscosity of the composition is of from about 100 to about 1900, about 200 to about 1800, about 300 to about 1700, about 400 to about 1600, about 500 to about 1500, about 600 to about 1400, about 700 to about 1300, about 800 to about 1200, about 900 to about 1100, about 1000 to about 1100, about 100 to about 500, about 150 to about 450, about 200 to about 400, about 200 to about 350, or about 250 to about 300, cps at about 70° F. measured at 20 rpm using an LV02 (62) spindle of a Brookfield Viscometer (DV2T). In various non-limiting embodiments, all values, both whole and fractional, between and including all of the above, are hereby expressly contemplated for use herein.

Fragrance

The fragrance is present in the composition in an amount of from about 0.1 to about 10 weight percent based on a total weight of the scent-boosting composition. In various embodiments, the fragrance is present in an amount of from about 0.5 to about 9.5, about 1 to about 9, about 1.5 to about 8.5, about 2 to about 8, about 2.5 to about 7.5, about 3 to about 7, about 3.5 to about 6.5, about 4 to about 6, about 4.5 to about 5.5, or about 5 to about 5.5, weight percent based on a total weight of the scent-boosting composition. In various non-limiting embodiments, all values, both whole and fractional, between and including all of the above, are hereby expressly contemplated for use herein.

The fragrance can be a neat oil, an encapsulated (neat or diluted) oil, or combinations thereof. The encapsulated oil may be any known in the art, e.g. an oil encapsulated in a melamine/formaldehyde shell. The aforementioned oils may be any known in the art to be fragrances. For example, the fragrance may be a fragrance oil, an essential oil, a plant extract or mixture thereof. The fragrance may be a perfume. In various embodiments, the fragrance is or includes one or more of the following, or combinations thereof:

i) hydrocarbons, such as, for example, 3-carene, alpha-pinene, beta-pinene, alpha-terpinene, gamma-terpinene, p-cymene, bisabolene, camphene, caryophyllene, cedrene, farnesene, limonene, longifolene, myrcene, ocimene, valencene, (E,Z)-1,3,5-undecatriene, styrene, and diphenylmethane;

ii) aliphatic alcohols, such as, for example, hexanol, octanol, 3-octanol, 2,6-dimethylheptanol, 2-methyl-2-heptanol, 2-methyl-2-octanol, (E)-2-hexenol, (E)- and (Z)-3-hexenol, 1-octn-3-ol, a mixture of 3,4,5,6,6-pentamethyl-3/4-hepten-2-ol and 3,5,6,6-tetramethyl-4-methyleneheptan-2-ol, (E,Z)-2,6-nonadienol, 3,7-dimethyl-7-methoxy-octan-2-ol, 9-decenol, 10-undecenol, 4-methyl-3-decen-5-ol, aliphatic aldehydes and their acetals such as for example hexanal, heptanal, octanal, nonanal, decanal, undecanal, dodecanal, tridecanal, 2-methyloctanal, 2-methylnonanal, (E)-2-hexenal, (Z)-4-heptenal, 2,6-dimethyl-5-heptenal, 10-undecenal, (E)-4-decenal, 2-dodecenal, 2,6,10-trimethyl-5,9-undecadienal, heptanal-diethylacetal, 1,1-dimethoxy-2,2,5-trimethyl-4-hexene, and citronellyl oxyacetaldehyde;

iii) aliphatic ketones and oximes thereof, such as, for example, 2-heptanone, 2-octanone, 3-octanone, 2-nonanone, 5-methyl-3-heptanone, 5-methyl-3-heptanone oxime, 2,4,4,7-tetramethyl-6-octen-3-one, aliphatic sulfur-containing compounds (e.g., 3-methylthiohexanol, 3-methylthiohexyl acetate, 3-mercaptohexanol, 3-mercaptohexyl acetate, 3-mercaptohexyl butyrate, 3-acetylthiohexyl acetate, and 1-menthene-8-thiol, and aliphatic nitriles (e.g., 2-nonenenitrile, 2-tridecenenitrile, 2,12-tridecenenitrile, 3,7-dimethyl-2,6-octadiencnitrile, and 3,7-dimethyl-6-octenenitrile);

iv) aliphatic carboxylic acids and esters thereof; such as, for example, (E)- and (Z)-3-hexenylformate, ethyl acetoacetate, isoamyl acetate, hexyl acetate, 3,5,5-trimethylhexyl acetate, 3-methyl-2-butenyl acetate, (E)-2-hexenyl acetate, (E)- and (Z)-3-hexenyl acetate, octyl acetate, 3-octyl acetate, 1-octan-3-yl acetate, ethyl butyrate, butyl butyrate, isoamyl butyrate, hexylbutyrate, (E)- and (Z)-3-hexenyl isobutyrate, hexyl crotonate, ethylisovalerate, ethyl-2-methyl pentanoate, ethyl hexanoate, allyl hexanoate, ethyl heptanoate, allyl heptanoate, ethyl octanoate, ethyl-(E,Z)-2,4-decadienoate, methyl-2-octinate, methyl-2-noninate, allyl-2-isoamyl oxyacetate, and methyl-3,7-dimethyl-2,6-octadienoate;

v) acyclic terpene alcohols, such as, for example, citronellol; geraniol; nerol; linalool; lavandulol; nerolidol; farnesol; tetrahydrolinalool; tetrahydrogeraniol; 2,6-dimethyl-7-octen-2-ol; 2,6-dimethyloctan-2-ol; 2-methyl-6-methylene-7-octen-2-ol; 2,6-dimethyl-5,7-octadien-2-ol; 2,6-dimethyl-3,5-octadien-2-ol; 3,7-dimethyl-4,6-octadien-3-ol; 3,7-dimethyl-1,5,7-octatrien-3-ol 2,6-dimethyl-2,5,7-octatrien-1-ol; as well as formates, acetates, propionates, isobutyrates, butyrates, isovalerates, pentanoates, hexanoates, crotonates, tiglinates and 3-methyl-2-butenoates thereof;

vi) acyclic terpene aldehydes and ketones, such as, for example, geranial, neral, citronellal, 7-hydroxy-3,7-dimethyloctanal, 7-methoxy-3,7-dimethyloctanal, 2,6,10-trimethyl-9-undecenal, alpha-sinensal, beta-sinensal, geranylacetone, as well as the dimethyl- and diethylacetals of geranial, neral and 7-hydroxy-3,7-dimethyloctanal;

vii) cyclic terpene alcohols, such as, for example, menthol, isopulegol, alpha-terpineol, terpinen-4-ol, menthan-8-ol, menthan-1-ol, menthan-7-ol, borneol, isoborneol, linalool oxide, nopol, cedrol, ambrinol, vetiverol, guaiol, and the formates, acetates, propionates, isobutyrates, butyrates, isovalerates, pentanoates, hexanoates, crotonates, tiglinates and 3-methyl-2-butenoates of alpha-terpineol, terpinen-4-ol, methan-8-ol, methan-1-ol, methan-7-ol, borneol, isoborneol, linalool oxide, nopol, cedrol, ambrinol, vetiverol, and guaiol;

viii) cyclic terpene aldehydes and ketones, such as, for example, menthone, isomenthone, 8-mercaptomenthan-3-one, carvone, camphor, fenchone, alpha-ionone, beta-ionone, alpha-n-methylionone, beta-n-methylionone, alpha-isomethylionone, beta-isomethylionone, alpha-irone, alpha-damascone, beta-damascone, beta-damascenone, .delta.-damascone, gamma-damascone, 1-(2,4,4-trimethyl-2-cyclohexen-1-yl)-2-buten-1-one, 1,3,4,6,7,8a-hexahydro-1,1,5,5-tetramethyl-2H-2,4a-methanonaphthalen-8(5H)-one, nootkatone, dihydronootkatone; acetylated cedarwood oil (cedryl methyl ketone);

ix) cyclic alcohols, such as, for example, 4-tert-butylcyclohexanol, 3,3,5-trimethylcyclohexanol, 3-isocamphylcyclohexanol, 2,6,9-trimethyl-Z2,Z5,E9-cyclo-dodecatrien-1-ol, 2-isobutyl-4-methyltetrahydro-2H-pyran-4-ol;

x) cycloaliphatic alcohols, such as, for example, alpha,3,3-trimethylcyclo-hexylmethanol, 2-methyl-4-(2,2,3-trimethyl-3-cyclopent-1-yl)butanol, 2-methyl-4-(2,2,3-trimethyl-3-cyclopent-1-yl)-2-buten-1-ol, 2-ethyl-4-(2,2,3-trimethyl-3-cyclopent-1-yl)-2-buten-1-ol, 3-methyl-5-(2,2,3-trimethyl-3-cyclopent-1-yl)-pentan-2-ol, 3-methyl-5-(2,2,3-trimethyl-3-cyclopent-1-yl)-4-penten-2-ol, 3,3-dimethyl-5-(2,2,3-trimethyl-3-cyclopent-1-yl)-4-penten-2-ol, 1-(2,2,6-trimethylcyclohexyl)pentan-3-ol, 1-(2,2,6-trimethylcyclohexyl)hexan-3-ol;

xi) cyclic and cycloaliphatic ethers, such as, for example, cineole, cedryl methyl ether, cyclododecyl methyl ether, xii) (ethoxymethoxy)cyclododecane; alpha-cedrene epoxide, 3a,6,6,9a-tetramethyldodecahydronaphtho[2,1-b]furan, 3a-ethyl-6,6,9a-trimethyldodecahydro-naphtho[2,1-b]furan, 1,5,9-trimethyl-13-oxabicyclo[10.1.0]-trideca-4,8-diene, rose oxide, 2-(2,4-dimethyl-3-cyclohexen-1-yl)-5-methyl-5-(1-methylpropyl)-1,3-dioxane;

xiii) cyclic ketones, such as, for example, 4-tert-butylcyclohexanone, 2,2,5-trimethyl-5-pentylcyclopentanone, 2-heptylcyclopentanone, 2-pentylcyclopentanone, 2-hydroxy-3-methyl-2-cyclopenten-1-one, 3-methyl-cis-2-penten-1-yl-2-cyclopenten-1-one, 3-methyl-2-pentyl-2-cyclopenten-1-one, 3-methyl-4-cyclopentadecenone, 3-methyl-5-cyclopentadecenone, 3-methylcyclopentadecanone, 4-(1-ethoxyvinyl)-3,3,5,5-tetramethylcyclohexanone, 4-tert-pentylcyclohexanone, 5-cyclohexadecen-1-one, 6,7-dihydro-1,1,2,3,3-pentamethyl-4(5H)-indanone, 5-cyclohexadecen-1-one, 8-cyclohexadecen-1-one, 9-cycloheptadecen-1-one, cyclopentadecanone, cycloaliphatic aldehydes, such as, for example, 2,4-dimethyl-3-cyclohexene carbaldehyde, 2-methyl-4-(2,2,6-trimethyl-cyclohexen-1-yl)-2-butenal, 4-(4-hydroxy-4-methylpentyl)-3-cyclohexene carbaldehyde, 4-(4-methyl-3-penten-1-yl)-3-cyclohexene carbaldehyde;

xiv) cycloaliphatic ketones, such as, for example, 1-(3,3-dimethylcyclohexyl)-4-penten-1-one, 1-(5,5-dimethyl-1-cyclohexen-1-yl)-4-penten-1-one, 2,3,8,8-tetramethyl-1,2,3,4,5,6,7,8-octahydro-2-naphtalenyl methyl-ketone, methyl-2,6,10-trimethyl-2,5,9-cyclododecatrienyl ketone, tert-butyl-(2,4-dimethyl-3-cyclohexen-1-yl)ketone;

xv) esters of cyclic alcohols, such as, for example, 2-tert-butylcyclohexyl acetate, 4-tert-butylcyclohexyl acetate, 2-tert-pentylcyclohexyl acetate, 4-tert-pentylcyclohexyl acetate, decahydro-2-naphthyl acetate, 3-pentyltetrahydro-2H-pyran-4-yl acetate, decahydro-2,5,5,8a-tetramethyl-2-naphthyl acetate, 4,7-methano-3a,4,5,6,7,7a-hexahydro-5 or 6-indenyl acetate, 4,7-methano-3a,4,5,6,7,7a-hexahydro-5 or 6-indenyl propionate, 4,7-methano-3a,4,5,6,7,7a-hexahydro-5 or 6-indenyl-isobutyrate, 4,7-methanooctahydro-5 or 6-indenyl acetate;

xvi) esters of cycloaliphatic carboxylic acids, such as, for example, allyl 3-cyclohexyl-propionate, allyl cyclohexyl oxyacetate, methyl dihydrojasmonate, methyl jasmonate, methyl 2-hexyl-3-oxocyclopentanecarboxylate, ethyl 2-ethyl-6,6-dimethyl-2-cyclohexenecarboxylate, ethyl 2,3,6,6-tetramethyl-2-cyclohexenecarboxylate, ethyl 2-methyl-1,3-dioxolane-2-acetate;

xvii) aromatic and aliphatic alcohols, such as, for example, benzyl alcohol, 1-phenylethyl alcohol, 2-phenylethyl alcohol, 3-phenylpropanol, 2-phenylpropanol, 2-phenoxyethanol, 2,2-dimethyl-3-phenylpropanol, 2,2-dimethyl-3-(3-methylphenyl)-propanol, 1,1-dimethyl-2-phenylethyl alcohol, 1,1-dimethyl-3-phenylpropanol, 1-ethyl-1-methyl-3-phenylpropanol, 2-methyl-5-phenylpentanol, 3-methyl-5-phenylpentanol, 3-phenyl-2-propen-1-ol, 4-methoxybenzyl alcohol, 1-(4-isopropylphenyl)ethanol;

xviii) esters of aliphatic alcohols and aliphatic carboxylic acids, such as, for example, benzyl acetate, benzyl propionate, benzyl isobutyrate, benzyl isovalerate, 2-phenylethyl acetate, 2-phenylethyl propionate, 2-phenylethyl isobutyrate, 2-phenylethyl isovalerate, 1-phenylethyl acetate, alpha-trichloromethylbenzyl acetate, alpha,alpha-dimethylphenylethyl acetate, alpha, alpha-dimethylphenylethyl butyrate, cinnamyl acetate, 2-phenoxyethyl isobutyrate, 4-methoxybenzyl acetate, araliphatic ethers, such as for example 2-phenylethyl methyl ether, 2-phenylethyl isoamyl ether, 2-phenylethyl-1-ethoxyethyl ether, phenylacetaldehyde dimethyl acetal, phenylacetaldehyde diethyl acetal, hydratropaaldehyde dimethyl acetal, phenylacetaldehyde glycerol acetal, 2,4,6-trimethyl-4-phenyl-, 3-dioxane, 4,4a,5,9b-tetrahydroindeno[1,2-d]-m-dioxin, 4,4a,5,9b-tetrahydro-2,4-dimethylindeno[1,2-d]-m-dioxin;

xix) aromatic and aliphatic aldehydes, such as, for example, benzaldehyde; phenylacetaldehyde, 3-phenylpropanal, hydratropaldehyde, 4-methylbenzaldehyde, 4-methylphenylacetaldehyde, 3-(4-ethylphenyl)-2,2-dimethylpropanal, 2-methyl-3-(4-isopropylphenyl)propanal, 2-methyl-3-(4-tert-butylphenyl)propanal, 3-(4-tert-butyl-phenyl) propanal, cinnamaldehyde, alpha-butylcinnamaldehyde, alpha-amylcinnam-aldehyde, alpha-hexylcinnamaldehyde, 3-methyl-5-phenylpentanal, 4-methoxy-benzaldehyde, 4-hydroxy-3-methoxybenzaldehyde, 4-hydroxy-3-ethoxybenzaldehyde, 3,4-methylene-dioxybenzaldehyde, 3,4-dimethoxybenzaldehyde, 2-methyl-3-(4-methoxyphenyl)propanal, 2-methyl-3-(4-methylendioxyphenyl)propanal;

xx) aromatic and aliphatic ketones, such as, for example, acetophenone, 4-methylacetophenone, 4-methoxyacetophenone, 4-tert-butyl-2,6-dimethylacetophenone, 4-phenyl-2-butanone, 4-(4-hydroxyphenyl)-2-butanone, 1-(2-naphthalenyl)ethanone, benzophenone, 1,1,2,3,3,6-hexamethyl-5-indanyl methyl ketone, 6-tert-butyl-1,1-dimethyl-4-indanyl methyl ketone, 1-[2,3-dihydro-1,1,2,6-tetramethyl-3-(1-methyl-ethyl)-1H-5-indenyl]ethanone, 5',6',7',8'-tetrahydro-3',5',5',6',8',8'-hexamethyl-2-aceto-naphthone;

xxi) aromatic and araliphatic carboxylic acids and esters thereof, such as, for example, benzoic acid, phenylacetic acid, methyl benzoate, ethyl benzoate, hexyl benzoate, benzyl benzoate, methyl phenylacetate, ethyl phenylacetate, geranyl phenylacetate, phenylethyl phenylacetate, methyl cinnamate, ethyl cinnamate, benzyl cinnamate, phenylethyl cinnamate, cinnamyl cinnamate, allyl phenoxyacetate, methyl salicylate, isoamyl salicylate, hexyl salicylate, cyclohexyl salicylate, cis-3-hexenyl salicylate, benzyl salicylate, phenylethyl salicylate, methyl 2,4-dihydroxy-3,6-dimethylbenzoate, ethyl 3-phenylglycidate, ethyl 3-methyl-3-phenylglycidate;

xxii) nitrogen-containing aromatic compounds, such as, for example, 2,4,6-trinitro-1,3-dimethyl-5-tert-butylbenzene, 3,5-dinitro-2,6-dimethyl-4-tert-butylaceto-phenone, cinnamonitrile, 5-phenyl-3-methyl-2-pentenonitrile, 5-phenyl-3-methyl-pentanonitrile, methyl anthranilate, methy-N-methylanthranilate, Schiffs bases of methyl anthranilate with 7-hydroxy-3,7-dimethyloctanal, 2-methyl-3-(4-tert-butylphenyl)-propanal or 2,4-dimethyl-3-cyclohexene carbaldehyde, 6-isopropylquinoline, 6-isobutyl-quinoline, 6-sec-butylquinoline, indole, skatole, 2-methoxy-3-isopropylpyrazine, 2-iso-butyl-3-methoxypyrazine;

xxiii) phenols, phenyl ethers and phenyl esters, such as, for example, estragole, anethole, eugenol, eugenyl methyl ether, isoeugenol, isoeugenol methyl ether, thymol, carvacrol, diphenyl ether, beta-naphthyl methyl ether, beta-naphthyl ethyl ether, beta-naphthyl isobutyl ether, 1,4-dimethoxybenzene, eugenyl acetate, 2-methoxy-4-methylphenol, 2-ethoxy-5-(1-propenyl)phenol, p-cresyl phenylacetate;

xxiv) heterocyclic compounds, such as, for example, 2,5-dimethyl-4-hydroxy-2H-furan-3-one, 2-ethyl-4-hydroxy-5-methyl-2H-furan-3-one, 3-hydroxy-2-methyl-4H-pyran-4-one, 2-ethyl-3-hydroxy-4H-pyran-4-one;

xxv) lactones, such as, for example, 1,4-octanolide, 3-methyl-1,4-octanolide, 1,4-nonanolide, 1,4-decanolide, 8-decen-1,4-olide, 1,4-undecanolide, 1,4-dodecanolide, 1,5-decanolide, 1,5-dodecanolide, 1,15-pentadecanolide, cis- and trans-1-pentadecen-1,15-olide, cis- and trans-12-pentadecen-1,15-olide, 1,16-hexadecanolide, 9-hexadecen-1,16-olide, 10-oxa-1,16-hexadecanolide, 11-oxa-1,16-hexadecanolide, 12-oxa-1,16-hexadecanolide, ethylene-1,12-dodecanedioate, ethylene-1,13-tridecanedioate, coumarin, 2,3-dihydrocoumarin, and octahydrocoumarin; and xxvi) essential oils, concretes, absolutes, resins, resinoids, balsams, tinctures such as for example ambergris tincture, amyris oil, angelica seed oil, angelica root oil, aniseed oil, valerian oil, basil oil, tree moss absolute, bay oil, armoise oil, benzoe resinoid, bergamot oil, beeswax absolute, birch tar oil, bitter almond oil, savory oil, buchu leaf oil, cabreuva oil, cade oil, calamus oil, camphor oil, cananga oil, cardamom oil, cascarilla oil, cassia oil, cassie absolute, castoreum absolute, cedar leaf oil, cedar wood oil, cistus oil, citronella oil, lemon oil, copaiba balsam, copaiba balsam oil, coriander oil, costus root oil, cumin oil, cypress oil, davana oil, dill weed oil, dill seed oil, eau de brouts absolute, oakmoss absolute, elemi oil, estragon oil, eucalyptus citriodora oil, eucalyptus oil (cineole type), fennel oil, fir needle oil, galbanum oil, galbanum resin, geranium oil, grapefruit oil, guaiacwood oil, gurjun balsam, gurjun balsam oil, helichrysum absolute, helichrysum oil, ginger oil, iris root absolute, iris root oil, jasmine absolute, calamus oil, blue camomile oil, Roman camomile oil, carrot seed oil, cascarilla oil, pine needle oil, spearmint oil, caraway oil, labdanum oil, labdanum absolute, labdanum resin, lavandin absolute, lavandin oil, lavender absolute, lavender oil, lemon-grass oil, lovage oil, lime oil distilled, lime oil expressed, linaloe oil, Litsea cubeba oil, laurel leaf oil, mace oil, marjoram oil, mandarin oil, massoi (bark) oil, mimosa absolute, ambrette seed oil, musk tincture, clary sage oil, nutmeg oil, myrrh absolute, myrrh oil, myrtle oil, clove leaf oil, clove bud oil, neroli oil, olibanum absolute, olibanum oil, opopanax oil, orange flower absolute, orange oil, origanum oil, palmarosa oil, patchouli oil, perilla oil, Peru balsam oil, parsley leaf oil, parsley seed oil, petitgrain oil, peppermint oil, pepper oil, pimento oil, pine oil, pennyroyal oil, rose absolute, rosewood oil, rose oil, rosemary oil, Dalmatian sage oil, Spanish sage oil, sandal-wood oil, celery seed oil: spike-lavender oil, star anise oil, storax oil, tagetes oil, fir needle oil, tea tree oil, turpentine oil, thyme oil, Tolu balsam, tonka bean absolute, tuberose absolute, vanilla extract, violet leaf absolute, verbena oil, vetiver oil, juniperberry oil, wine lees oil, wormwood oil, wintergreen oil, ylang-ylang oil, hyssop oil, civet absolute, cinnamon leaf oil, cinnamon bark oil, and fractions thereof or ingredients isolated therefrom.

Saccharide:

The saccharide is present in the composition in an amount of from about 45 to about 75 weight percent based on a total weight of the composition. In various embodiments, the saccharide is present in an amount of from about 50 to about 70, about 55 to about 65, or about 60 to about 65, weight percent based on a total weight of the composition. As is known in the art, some saccharides are provided from the manufacturer as a solution of the saccharide and water. Such a solution may include a single saccharide or more than one saccharide. The aforementioned weight percentages describe the weight of the saccharide (or the total weight of the more than one saccharide) without the water. In other words, if about 92 weight percent of a saccharide solution is used to form the composition of this disclosure, such a solution may only include about 67 to about 72 weight percent of the saccharide with the rest of the solution (e.g. about 20 to about 25 weight percent) being water. In various embodiments, the saccharide may include any amount of water as is known in the art, including, but not limited to, 15, 16, 17, 18, 19, 20, 21, 22, 23, 24, 25, or more, weight percent based on a total weight of a solution including the saccharide and the water. In various non-limiting embodiments, all values, both whole and fractional, between and including all of the above, are hereby expressly contemplated for use herein.

The saccharide may be any known in the art. In various embodiments, the saccharide is chosen from fructose, glucose, sucrose, xylitol, sorbitol, mannitol, erythritol, dulcitol, inositol, adonitol, tagatose, trehalose, galactose, rhamnose, cyclodextrin, maltodextrin, dextran, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, high fructose corn/starch syrup, coupling sugars, soybean oligosaccharides, or glucose syrup, or a mixture thereof. In other embodiments, the saccharide is chosen from fructose, glucose, and combinations thereof.

In one embodiment, the saccharide is high fructose corn syrup (HFCS), which may be any known in the art. The terminology "high" is as understood by those of skill in the art and typically describes that a majority of the syrup comprises fructose as opposed to other sugars such as glucose or sucrose. For example, the high fructose corn syrup may be a blend of approximately 23% water and 77% saccharide. For example, HFCS 55 typically describes a blend of water (about 23%), glucose (about 34%), and fructose (about 42%). However, in a dried form, HFCS 55 includes approximately 55% fructose by weight of dry HFCS. Similarly, HFCS 42 includes approximately 42% fructose by weight of dry HFCS. HFCS 65 includes approximately 65% fructose by weight of dry HFCS. HFCS 90 includes approximately 90% fructose by weight of dry HFCS. This disclosure may utilize one or more of these saccharides alone or in one or more combinations with one another.

HFCS is typically a wet blend which includes water, as it is supplied from HFCS manufacturers. However, it should be understood that dry or essentially dry hybrids of monosaccharides (e.g. HFCS), wherein water has been removed partially or completely, can also be used. While pure fructose is very viscous and hard to handle, HFCS is more diluted and easier to handle. HFCS is also more cost-effective to manufacture.

Surfactant:

The composition includes the surfactant in an amount of from about 0.1 to about 6 weight percent based on a total weight of the composition. In various embodiments, the surfactant is present in an amount of from about 0.5 to about 5.5, about 1 to about 5, about 1.5 to about 4.5, about 2 to about 4, about 2.5 to about 3.5, or about 3 to about 3.5, weight percent based on a total weight of the composition. In various non-limiting embodiments, all values, both whole and fractional, between and including all of the above, are hereby expressly contemplated for use herein.

The surfactant may be singular or a combination of two or more surfactants. Any one or more of the surfactants used herein may be anionic, cationic, non-ionic, or zwitterionic, or any combination thereof. In one embodiment, the surfactant is a combination of one or more anionic surfactants and one or more non-ionic surfactants.

In various embodiments, suitable surfactants that are anionic include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms, and/or alcohol ethoxysulfates. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters, and lauryl ether sulfates.

In other embodiments, suitable surfactants that are cationic may include compounds of the general formula X, XI, or XII as illustrated below:

(X)

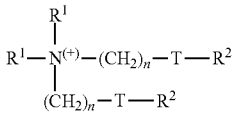

(XI)

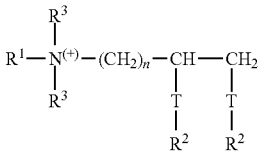

(XII)

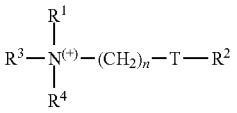

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$, —O—CO—, or —CO—O—, and n is an integer from 0 to 5.

The surfactants that are cationic may include conventional anions of a nature and number required for charge balancing. Alternatively, the surfactant may include anionic surfactants that may function to balance the charges with the cationic surfactants. In some embodiments, surfactants that are cations may include hydroxyalkyltrialkylammonium compounds, such as $C_{12}$-$C_{18}$ alkyl(hydroxyethyl)dimethyl ammonium compounds, and may include the halides thereof, such as chlorides or other halides. The surfactants that are cations may be especially useful for compositions intended for treating textiles.

Suitable examples of nonionic surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

In other embodiments, the surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters.

In various embodiments, the surfactant is a $C_{12}$-$C_{15}$ alcohol ethoxylate that is capped with approximately 7 moles of ethylene oxide. In other embodiments, the surfactant is an alcohol alkoxylate that has from 6 to 20, 8 to 18, 10 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 1 to about 15, about 2 to about 14, about 3 to about 13, about 4 to about 12, about 5 to about 11, about 6 to about 10, about 7 to about 9, or about 8 to about 9, moles.

Water:

Water is present in the composition in an amount of from about 10 to about 25 weight percent based on a total weight of the composition. In various embodiment, the water is present in an amount of from about 10 to about 15, about 15 to about 20, about 20 to about 25, or about 15 to about 25, weight percent based on a total weight of the composition. In various non-limiting embodiments, all values, both whole and fractional, between and including all of the above, are hereby expressly contemplated for use herein. The water may be present as part of one or more components, such as the saccharide, or may be added independently to the composition, or both.

Non-Aqueous Solvent

The composition may include, or may be free of, a non-aqueous solvent. In various embodiments, the non-aqueous solvent is present in an amount of from about 1 to about 30, about 3 to about 30, about 5 to about 30, about 10 to about 25, or about 15 to about 20, weight percent based on a total weight of the composition. In various non-limiting embodiments, all values, both whole and fractional, between and including all of the above, are hereby expressly contemplated for use herein.

The non-aqueous solvent is not particularly limited and may be any known in the art. In various embodiments, the non-aqueous solvent is chosen from glycerol (glycerin), propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; tetramethylene glycol; butylene glycol; pentanediol; hexylene glycol; heptylene glycol; octylene glycol; 2-methyl, 1,3 propanediol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide/propylene oxide block copolymers. In various non-limiting embodiments, all values, both whole and fractional, between and including all of the above, are hereby expressly contemplated for use herein.

Additives:

The composition may include one or more of the following additives or may be free of one or more of the following additives. For example, the composition may include one or more foam inhibitors. Suitable foam inhibitors include, but are not limited to, fatty acids such as coconut fatty acids. The composition may include the foam inhibitor at an amount of from about 0 to about 10 weight percent, based on the total weight of the composition.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition.

In one embodiment, the composition is free of, or includes less than 5, 4, 3, 2, 1, 0.5, or 0.1, weight percent of, a solvent other than water, e.g. any organic solvent, non-polar solvent, polar aprotic solvent, polar protic solvent, etc. and combinations thereof. In another embodiment, the composition is free of, or includes less than 5, 4, 3, 2, 1, 0.5, or 0.1, weight percent of, propylene glycol and/or glycerine.

Weight Percents/Ratios of Various Components:

The fragrance, saccharide, surfactant and water are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples.

In one embodiment, the saccharide is present in an amount of from about 67 to about 73 based on a total weight of the scent-boosting composition. In another embodiment, the saccharide is present in an amount of from about 51 to about 71 based on a total weight of the scent-boosting composition. In a further embodiment, the fragrance, saccharide, surfactant, and water are present in a weight ratio of (about 4 to about 6):(about 65 to about 71):(about 3):(about 21 to about 24), respectively. In another embodiment, fragrance, saccharide, surfactant, and water are present in a weight ratio of: about 5:about 71:about 3:about 21, respectively; about 4:about 71:about 3:about 22, respectively; about 6:about 67:about 3:about 24, respectively; about 5:about 65:about 3:about 23, respectively; or about 5:about 71:about 3:about 21, respectively. In another embodiment, the fragrance and the saccharide are present in a weight ratio of about (4 to 6):about (65 to 73), respectively.

In various embodiments, the single dose pack of claim further includes a non-aqueous solvent. In such embodiments, the saccharide, non-aqueous solvent, fragrance, and surfactant can be present in various weight ratios, e.g. (about 52 to about 67):(about 5 to about 25):(about 5):(about 3), respectively. In another embodiment, the saccharide, non-aqueous solvent, fragrance, and surfactant are present in a weight ratio of: about 67:about 5:about 5:about 3, respectively; about 59:about 15:about 5:about 3, respectively; or about 52:about 25:about 5:about 3, respectively. In various non-limiting embodiments, all values, both whole and fractional, between and including all of the above, are hereby expressly contemplated for use herein.

Method of Forming Single Dose Pack:

This disclosure also provides a method of forming the single dose pack. The composition is typically first formed, e.g. using shear mixing. Shear mixing may be conducted using an over-the-head mixer such as an IKA RW 20 Digital Mixer at 500 rpm. The composition may then be encapsulated within a container by depositing the composition within the container. The container may then be sealed to encase and enclose the composition within the container to form the single dose pack. The composition is typically in direct contact with the film of the container within the single dose pack. The film of the container is typically sealable by heat, heat and water, ultrasonic methods, or other techniques, and one or more sealing techniques may be used to enclose the composition within the container.

Method of Forming the Single Dose Scent Boosting Composition:

This disclosure further provides a method of forming the single dose scent boosting composition. The method includes the step of combining the fragrance, saccharide, surfactant, and water to form the single dose scent boosting composition. Each of the aforementioned components may be combined in any order and in whole or partial amounts. Moreover, any of the aforementioned additives may be combined as well with one or more of the aforementioned fragrance, saccharide, surfactant, or water. All orders of addition are hereby expressly contemplated for use in various non-limiting embodiments.

EXAMPLES

A series of compositions are formed as set forth below in Table 1, both representative of embodiments of this disclosure (Inventive) and comparative (Comp.). All values set forth in Table 1 are in parts by weight per 100 parts by weight of the Compositions.

TABLE 1

| Composition | 1 (Inventive) | 2 (Comp.) | 3 (Comp.) | 4 (Comp.) |
|---|---|---|---|---|
| Saccharide High Fructose Corn Syrup 55 (Includes Water) | 91.95 (Includes water (21.15) and total Saccharide (70.80)) | 94.95 (Includes water (21.84) and total Saccharide (73.11)) | — | — |
| Additional Water Added to Composition | — | — | 21.5 | 21.5 |
| Glycerine | — | — | 70.45 | — |
| Propylene Glycol | — | — | — | 70.45 |
| Fragrance Vanilla Chamomile 449855 BP50 | 5 | 5 | 5 | 5 |
| Encapsulated Fragrance: Maxwell Pop ACM 259366 MHB2915 (Slurry of Encapsulated Fragrance in Water) | — | — | — | — |

TABLE 1-continued

| | | | | |
|---|---|---|---|---|
| Encapsulated Fragrance PREMIX: Maxwell Pop ACM 259366 MHB2915 (Diluted Slurry in Additional Water) | — | — | — | — |
| Bitrex (25% active) | 0.05 | 0.05 | 0.05 | 0.05 |
| C12-C15 Alcohol Ethoxylate 7EO | 3 | — | 3 | 3 |
| Liquitint Blue HP Dye | — | — | — | — |
| Total | 100 | 100 | 100 | 100 |
| Stability | Stable after being stored at a temperature of 75° F. temperature and 50% humidity for 1 week | Unstable - Fragrance Separation | Unstable - Packs begin to dissolve upon creation | Unstable - Packs begin to dissolve upon creation |

| Composition | 5 (Inventive) | 6 (Inventive) | 7 (Comp.) | 8 (Comp.) |
|---|---|---|---|---|
| Saccharide High Fructose Corn Syrup 55 (Includes Water) | 92.92 (Includes water (22.37) and total Saccharide (70.55)) | 90.92 (Includes water (23.91) and total Saccharide (67.01)) | — | — |
| Additional Water Added to Composition | — | — | 21 | 21 |
| Glycerine | — | — | 71.95 | 69.95 |
| Propylene Glycol | — | — | — | — |
| Fragrance Vanilla Chamomile 449855 BP50 | 2 | 2 | 2 | 2 |
| Encapsulated Fragrance: Maxwell Pop ACM 259366 MHB2915 (Slurry of Encapsulated Fragrance in Water) | 2 | — | 2 | — |
| Encapsulated Fragrance PREMIX: Maxwell Pop ACM 259366 MHB2915 (Diluted Slurry in Additional Water) | — | 4 | — | 4 |
| Bitrex (25% active) | 0.05 | 0.05 | 0.05 | 0.05 |
| C12-C15 Alcohol Ethoxylate 7EO | 3 | 3 | 3 | 3 |
| Liquitint Blue HP Dye | 0.03 | 0.03 | 0.03 | 0.03 |
| Total | 100 | 100 | 100 | 100 |
| Stability | Stable after being stored at a temperature of 75° F. temperature and 50% humidity for 1 week | Stable after being stored at a temperature of 75° F. temperature and 50% humidity for 1 week | Unstable - Packs begin to dissolve upon creation | Unstable - Packs begin to dissolve upon creation |

| | 9 (Comp.) | 10 (Comp.) |
|---|---|---|
| Saccharide High Fructose Corn Syrup 55 (Includes Water) | — | — |
| Additional Water Added to Composition | 21 | 21 |
| Glycerine | — | — |
| Propylene Glycol | 71.95 | 69.95 |
| Fragrance Vanilla Chamomile 449855 BP50 | 2 | 2 |
| Encapsulated Fragrance: Maxwell Pop ACM 259366 MHB2915 (Slurry of Encapsulated Fragrance in Water) | 2 | — |

TABLE 1-continued

| | | |
|---|---|---|
| Encapsulated Fragrance PREMIX: Maxwell Pop ACM 259366 MHB2915 (Diluted Slurry in Additional Water) | — | 4 |
| Bitrex (25% active) | 0.05 | 0.05 |
| C12-C15 Alcohol Ethoxylate 7EO | 3 | 3 |
| Liquitint Blue HP Dye | 0.03 | 0.03 |
| Total | 100 | 100 |
| Stability | Unstable - Packs begin to dissolve upon creation | Unstable - Packs begin to dissolve upon creation |

In Table 1 above, the components are as follows:

Saccharide is High Fructose Corn Syrup 55 which includes a content of water from the manufacturer. High Fructose Corn Syrup 55 typically includes a blend of water (about 23%), glucose (about 34%), and fructose (about 42%). However, in a dried form, High Fructose Corn Syrup 55 includes approximately 55% fructose by weight of dry HFCS.

Additional Water Added to Composition refers to an additional amount of water added to the composition over and above the amount of water present in the Saccharide provided by the manufacturer.

Maxwell Pop ACM 259366 MHB2915 is an encapsulated fragrance. This fragrance is a neat oil encapsulated in a melamine-formaldehyde shell and supplied as a slurry of approximately 70% by weight of water and approximately 30% by weight of the encapsulated fragrance.

Encapsulated Fragrance PREMIX refers to a diluted version of the aforementioned slurry. For this Premix, the aforementioned slurry of approximately 70% by weight of water and approximately 30% by weight of the encapsulated fragrance is diluted 1:1 with additional water. Accordingly, this dilution results in a slurry of approximately 85% by weight of water and approximately 15% by weight of the encapsulated fragrance.

Bitrex is a bittering additive, which is a 25% active solution in water.

Surfactant is a $C_{12}$-$C_{15}$ Alcohol Ethoxylate that is capped with approximately 7 moles of ethylene oxide.

Stability refers to observed stability of a single chamber pack formed using Monosol M8312 film that is 76 microns thick and 20 grams of each Composition per pack. Stability refers to visual and tactile observation of no floppiness of the pack, no pack leakage, no pack fusion, no observable insolubility of the components in the pack, and no observable phase separation of the components in the pack.

As shown in Table 1, there are two grouping of data. The first grouping focuses on use of a fragrance as a neat oil (See Compositions 1-4). The second grouping focuses on use of a fragrance as a neat oil and also fragrance as an encapsulated oil (See Compositions 5-10).

Composition 1 utilizes High Fructose Corn Syrup 55 and a surfactant. The results associated with using Composition 1 are that a stable pack can be formed, as set forth in FIG. 1.

Composition 2 is comparative because it does not utilize a surfactant. The results associated with using Composition 2 are that a stable pack can be formed but there is visual phase separation of the neat fragrance oil from the water in the pack, as also set forth in FIG. 1. Over time, this leads to degeneration of the pack which makes it unsuitable for commercial use.

Compositions 3 and 4 are comparative because they do not utilize the high fructose corn syrup and instead add additional water, glycerine, and propylene glycol to the pack to back fill and replace what would be the high fructose corn syrup in the examples of this disclosure. The results associated with using Compositions 3 and 4 are that stable packs cannot be formed. Said differently, the packs formed using Compositions 3 and 4 are not structurally sound and breakdown prior to use. Accordingly, they are not suitable for manufacture, storage, and eventual use.

Compositions 5 and 6 are representative of this disclosure and using varying amounts of the high fructose corn syrup. The difference between Compositions 5 and 6 is the way the fragrance is formed and utilized. Composition 5 utilizes an encapsulated fragrance wherein the fragrance is utilized as a slurry. Composition 6 uses the same encapsulated fragrance except that it is made using a premixture at a 1:1 weight ratio of the slurry with water.

Relative to Compositions 1, 5, and 6, the fragrance, saccharide, surfactant, and water are present in a weight ratio of: about 5:about 71:about 3:about 21, respectively; about 4:about 71:about 3:about 22, respectively; or about 6:about 67: about 3:about 24, respectively. These weight ratios produce superior and unexpected results as described in greater detail below.

Compositions 7-10 are comparative and not representative of this disclosure for various reasons. Compositions 7 and 8 mirror Compositions 5 and 6, respectively, except that they do not utilize the high fructose corn syrup and instead utilize additional water and include glycerine to back fill and replace what would be the high fructose corn syrup in Compositions 5 and 6.

Compositions 9 and 10 also mirror Compositions 5 and 6, respectively, except that they do not utilize the high fructose corn syrup and instead utilize additional water and include propylene glycol to back fill and replace what would be the high fructose corn syrup in Compositions 5 and 6.

In additional Examples that are each representative of various embodiments of this disclosure, additional compositions (A-E) below are formed using the components set forth below in Table 2.

TABLE 2

| Composition | A | B | C | D | E |
|---|---|---|---|---|---|
| Saccharide High Fructose Corn Syrup 55 (Includes Water) | 88.95 (Includes water (23.46) and total Saccharide (65.49)) | 91.95 (Includes water (21.15) and total Saccharide (70.80)) | 86.95 (Includes water (20.00) and total Saccharide (66.95)) | 76.95 (Includes water (17.70) and total Saccharide (59.25)) | 66.95 (Includes water (15.40) and total Saccharide (51.55)) |
| Additional Water Added to Composition | 3 | — | — | — | — |
| Polyethylene Glycol 400 | — | — | 5 | 15 | 25 |
| Glycerine | — | — | — | — | — |
| Propylene Glycol | — | — | — | — | — |
| Fragrance Neat Oil: Vanilla Chamomile 449855 BP50 | 5 | 5 | 5 | 5 | 5 |
| Bitrex (25% active) | 0.05 | 0.05 | 0.05 | 0.05 | 0.05 |
| C12-C15 Alcohol Ethoxylate 7EO | 3 | 3 | 3 | 3 | 3 |
| Total | 100 | 100 | 100 | 100 | 100 |
| Pack Height (inches) | 0.85 | 0.88 | 0.90 | 0.90 | 0.91 |

Relative to Table 2, the same descriptions of the components apply as is set forth above relative to Table 1.

Polyethylene Glycol 400 has an approximate weight average molecular weight of 400 g/mol.

Pack Height (inches) refers to data measured after the packs rested for 1 hr. at 25° C. after formation. The packs are formed using 20 g of one of the Compositions A-E encapsulated in Monosol M8312 film that is 76 microns thick. The height of the pack is indicative of how much the pack has softened, broken down, plasticized, and/or dissolved as a result of the Compositions disposed therein. A pack with no softening, break down, etc. has a higher pack height and is firm to the touch. A pack with softening and break down begins to sag and is soft to the touch. Therefore, higher pack heights are indicative of less breakdown of the film and are preferred.

The Compositions A-E all exhibit excellent pack heights. In other words, these packs exhibit minimal softening, break down, plasticizing, and/or premature dissolution. Relative to Compositions A and B, the fragrance, saccharide, surfactant, and water are present in a weight ratio of: about 5:about 65:about 3:about 23, respectively; or about 5:about 71:about 3:about 21, respectively. Relative to Compositions C-E, the saccharide, non-aqueous solvent, fragrance, and surfactant are present in a weight ratio of: about 67:about 5:about 5:about 3, respectively; about 59:about 15:about 5:about 3, respectively; or about 52:about 25:about 5:about 3, respectively. These weight ratios produce superior and unexpected results as described in greater detail below.

In addition, Compositions 3 and 4, as set forth above in Table 1, were also evaluated to determine Pack Height. These Compositions did not form stable packs such that pack height could not even be evaluated. In other words, the films used to form packs that included Compositions 3 and 4 dissolved and/or broke down before viable packs could be formed. Therefore, such packs are not useable or suitable for pack height measurement. Accordingly, the Compositions A-E are far superior in this regard.

The aforementioned results show the use of a saccharide surprisingly allows for large amounts of water to be included in single dose packs. For example, the Compositions of this disclosure include water contents of above about 21 wt % and yet can still be used to form packs that are stable (see, e.g. Composition 1). This water content is approximately 50% higher than standard water contents of known commercial examples that include, at most, about 14 wt % of water. This increase in water content is unexpected, superior, and important because use of water allows for simplified formulations to be produced, less chemicals to be used, less chemical waste to be generated, and decreased production costs to be realized.

Moreover, the aforementioned results show that use of a small amount of a non-aqueous solvent, such as propylene glycol, even further improves the stability of the packs (see, e.g. Compositions C, D, and E). This synergistic action of the saccharide and the non-aqueous solvent is unexpected, superior, and important for all of the aforementioned reasons and further because the packs are even more stable (see pack heights of 0.90 and 0.91). This increased stability allows the packs to be used in a wider variety of environments and reduces premature breakdown and release of contents.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A single dose scent-boosting pack comprising:

a container comprising a water-soluble film; and a single dose scent-boosting composition encapsulated within said container, wherein said single dose scent-boosting composition comprises:

A. about 0.1 to about 10 weight percent of a fragrance based on a total weight of said scent-boosting composition;

B. about 45 to about 75 weight percent of a saccharide based on a total weight of said scent-boosting composition;

C. about 0.1 to about 6 weight percent of a surfactant based on a total weight of said scent-boosting composition; and D. about 10 to about 25 weight percent of water based on a total weight of said scent-boosting composition.

2. The single dose pack of claim 1 wherein said saccharide is chosen from fructose, glucose, and combinations thereof.

3. The single dose pack of claim 1 wherein said saccharide is high fructose corn syrup.

4. The single dose pack of claim 3 wherein said high fructose corn syrup is chosen from a corn syrup comprising about 42 wt % of fructose based on a total weight of dry high fructose corn syrup, a corn syrup comprising about 55 wt % of fructose based on a total weight of dry high fructose corn syrup, a corn syrup comprising about 65 wt % of fructose based on a total weight of dry high fructose corn syrup, a corn syrup comprising about 90 wt % of fructose based on a total weight of dry high fructose corn syrup, and combinations thereof.

5. The single dose pack of claim 3 wherein said high fructose corn syrup comprises about 55 wt % of fructose based on a total weight of dry high fructose corn syrup.

6. The single dose pack of claim 1 wherein said saccharide is present in an amount of from about 67 to about 73 wt % based on a total weight of said scent-boosting composition.

7. The single dose pack of claim 1 wherein said saccharide is present in an amount of from about 51 to about 71 wt % based on a total weight of said scent-boosting composition.

8. The single dose pack of claim 1 wherein said fragrance, saccharide, surfactant, and water are present in a weight ratio of about (4 to 6):about (65 to 71):about (3):about (21 to 24), respectively.

9. The single dose pack of claim 1 wherein said fragrance, saccharide, surfactant, and water are present in a weight ratio of:

about 5:about 71:about 3:about 21, respectively;

about 4:about 71:about 3:about 22, respectively;

about 6:about 67:about 3:about 24, respectively;

about 5:about 65:about 3:about 23, respectively; or about 5:about 71:about 3:about 21, respectively.

10. The single dose pack of claim 1 wherein said fragrance and said saccharide are present in a weight ratio of about (4 to 6):about (65 to 73).

11. The single dose pack of claim 1 wherein said surfactant is a non-ionic surfactant.

12. The single dose pack of claim 11 wherein said non-ionic surfactant is an alcohol ethoxylate.

13. The single dose pack of claim 12 wherein said alcohol ethoxylate is a $C_{12}$-$C_{15}$ alcohol ethoxylate capped with about 7 moles of ethylene oxide.

14. The single dose pack of claim 1 wherein said surfactant is present in an amount of about 2 to about 4 weight percent based on a total weight of said scent-boosting composition.

15. The single dose pack of claim 1 further comprising a non-aqueous solvent present in an amount of from about 5 to about 30 weight percent based on a total weight of said scent-boosting composition.

16. The single dose pack of claim 15 wherein said non-aqueous solvent is polyethylene glycol having a weight average molecular weight of about 400 g/mol.

17. The single dose pack of claim 15 wherein said saccharide, non-aqueous solvent, fragrance, and surfactant are present in a weight ratio of:

about 67:about 5:about 5:about 3, respectively;

about 59:about 15:about 5:about 3, respectively; or about 52:about 25:about 5:about 3, respectively.

18. The single dose pack of claim 1 wherein said scent-boosting composition is free of propylene glycol and/or glycerine.

19. A single dose scent-boosting pack comprising:

a container comprising a water-soluble film; and a single dose scent-boosting composition encapsulated within said container, wherein said single dose scent-boosting composition consists of:

A. about 0.1 to about 10 weight percent of a fragrance based on a total weight of said scent-boosting composition;

B. about 45 to about 75 weight percent of a saccharide based on a total weight of said scent-boosting composition;

C. about 0.1 to about 6 weight percent of a surfactant based on a total weight of said scent-boosting composition; and D. about 10 to about 25 weight percent of water based on a total weight of said scent-boosting composition.

20. A single dose scent-boosting pack comprising:

a container comprising a water-soluble film; and a single dose scent-boosting composition encapsulated within said container and having a viscosity of from about 100 to about 500 cps at about 70° F. measured at 20 rpm using an LV02 (62) spindle of a Brookfield Viscometer (DV2T), wherein said single dose scent-boosting composition comprises:

A. about 4 to about 6 weight percent of a fragrance based on a total weight of said scent-boosting composition;

B. about 65 to about 75 weight percent of a high fructose corn syrup based on a total weight of said scent-boosting composition;

C. about 2 to about 4 weight percent of a $C_{12}$-$C_{15}$ alcohol ethoxylate capped with about 7 moles of ethylene oxide based on a total weight of said scent-boosting composition; and D. about 20 to about 25 weight percent of water based on a total weight of said scent-boosting composition, wherein said scent-boosting composition is free of glycerine and propylene glycol.

* * * * *